United States Patent [19]

Schwartzman

[11] 4,067,665

[45] Jan. 10, 1978

[54] TURBINE BOOSTER PUMP SYSTEM

[76] Inventor: Everett H. Schwartzman, 724 Cloyden Road, Palos Verdes Estates, Calif. 90274

[21] Appl. No.: 587,105

[22] Filed: June 16, 1975

[51] Int. Cl.[2] ..... F04B 3/00; F04G 25/00

[52] U.S. Cl. ..... 417/245; 415/149 R; 417/323; 417/382

[58] Field of Search ..... 417/245, 244, 323, 382; 415/149

[56] References Cited

U.S. PATENT DOCUMENTS

| | | | |
|---|---|---|---|
| 1,110,864 | 9/1914 | Banner | 417/323 |
| 2,475,316 | 7/1949 | Garraway | 417/245 |
| 2,770,943 | 11/1956 | Beale | 415/149 |
| 3,004,494 | 10/1961 | Corbett | 417/245 |
| 3,099,433 | 7/1963 | Wagner et al. | 415/149 |
| 3,365,892 | 1/1968 | Derderian | 415/149 |
| 3,826,594 | 7/1974 | Hornschunch et al. | 417/245 |

FOREIGN PATENT DOCUMENTS

| | | | |
|---|---|---|---|
| 730,647 | 5/1955 | United Kingdom | 417/245 |

*Primary Examiner*—Carlton R. Croyle
*Assistant Examiner*—R. E. Gluck
*Attorney, Agent, or Firm*—Mario A. Martella

[57] ABSTRACT

An improved pump system includes a booster turbine unit including a turbine mounted on the same shaft as the booster pump and utilizing a primary pump as the primary fluid power source. Various forms of turbine and booster pump may be used such that either the pressure or rate of flow from the primary pump may be increased substantially by a relatively simple and reliable system. The output of the primary pump may be flowed through the booster turbine including the booster pump or one fluid may be used as the same source and another as the pump system output. Various forms and designs are described.

36 Claims, 11 Drawing Figures

73
4
84
76
78
80
98
96
94
106
110
18
59
108
6
60
90
92
104
72
102
74
16
66
26
22
70
82
88
86
100

73
4
108
59
102
18
118
122
124
126
128
130
132
140
142
6
60
136
16
138
26
22
120
86
66
134

TURBINE BOOSTER PUMP SYSTEM

BACKGROUND OF THE INVENTION

The present invention relates to a pump system and more particularly to an improved pump system for obtaining high pressure ratios at relatively low mass flow rates at relatively high efficiencies.

It is well known that in order for a conventional pump or compressor to operate efficiently, there are certain conditions which should be met. These conditions may be depicted by two dimensionless parameters known as:

1. Specific Speed $$N_s = N\sqrt{V_1}/\Delta H^{\frac{3}{4}}$$

2. Specific Diameter $$D_s = D\Delta H^{\frac{1}{4}}/\sqrt{V_1}$$

Where:

$N$ = rpm $V_1$ = Volume flow rate (ft³/sec)

$D$ = Diameter of Impeller (ft)

$\Delta H$ = Adiabatic head (pumped) (ft)

The relationship of these parameters in terms of various designs of pumps and compressors may be expressed as a group of plots for radial design types, mixed flow design types and axial design types of compressors and pumps. From these graphical data, it becomes apparent that high efficiency of the device, a desirable design and operational quality, is only obtained over a specified region of the applicable curve.

In practice, however, pump and compressor performance in many cases is limited by the requirements set forth in the utilization of the available drive mechanisms. Thus, in most commercial applications using an electrical drive, the electrical motor speed is generally around 3400 rpm because of the use of 60 cps (Hertz) alternating current drives. In instances where large powers are contemplated, e.g. secondary oil reclamation, internal combustion engines (diesels or gas powered) drives may be employed and again there are practical limitations on speed of the power source, usually around 1800 to 3600 rpm.

In certain commercial operations such as reverse osmosis, boiler feed water systems, secondary oil recovery and oil field operations, chemical proportioning and mixing in chemical processing, fire fighting equipment, hydraulic mining and descaling and cleaning operations, to mention only a few operations, there is a need for fluid handling systems capable of generating a relatively high pressure flow at a relatively low volume flow rate, for example 60 gallons per minute at 500 psi.

As is known in the pump art, for a given fluid system the output pressure of the pump is a function of the square of the impeller tip velocity times the density of the fluid divided by 2g per stage. Thus, to provide the relatively high pressure, a substantial impeller tip speed is needed. The tip velocity is, as a practical matter, related to the rpm of the power source. Thus, some mechanism must be provided to obtain the high velocity tip speed needed to produce the desired pressure.

One possible approach is to use an impeller of a sufficient diameter to produce the desired tip speed for the power source. Calculations show that relatively large impeller diameters will be needed with accompanying relatively high disc friction resulting in poor efficiency, i.e. far greater horse power than for other systems. Thus, one of the principal problems for relatively high pressure and low flow rate systems is achieving the impeller tip speed needed from a power source whose rpm is in the range of 1800 to 3400 rpm due to the nature of the power source while achieving an acceptable efficiency for the system.

DESCRIPTION OF THE PRIOR ART

One approach taken by the prior art is the use of a plurality of stages in a centrifugal pump, i.e. 38 to 72 stages such that the pressure on the fluid is increased from one stage to the next, the impeller of each stage being on common driven shaft. Another approach is the use of a motor to drive a gear set which provides high speed rotation to an impeller. Each of these approaches represents a unit of relatively low efficiency of between 40 to 60%, and in the case of the gear unit there is the objection of noise and reliability. Each of the units is also relatively expensive.

Another difficulty with the prior art devices is the problem of cavitation, especially with high speed impellers, in that the fluid being pumped tends to vaporize in the volume to the rear of the impeller resulting in damage to the impeller and pump chamber.

U.S. Pat. No. 2,131,611 of Sept. 27, 1938 describes a hydraulic turbine used both as a pump and a turbine for generating electrical current. A single drive shaft is used on which the turbine impeller is mounted.

SUMMARY OF THE INVENTION

This invention relates to a pumping system and more particularly to an improved pumping system for obtaining high pressure ratios at relatively low mass flow rates at relatively high efficiencies by the use of an improved assemblage of primary pump, boost turbine and booster pump.

In its broader aspects, the present invention provides a pump system capable of providing a wide variety of output pressures at the desired flow rate while achieving optimum efficiency by a relatively simple and reliable mechanism.

The given invention is a unique way in which to obtain almost any pressure at the desired flow rate all at the optimum efficiencies. This is accomplished, as set out in detail below, by being able to circumvent the speed limitation imposed upon the available drives.

The manner in which this is accomplished is set out as follows:

Depending on the required output conditions which in turn determine the necessary power input (including all of the losses) a standard appropriately suited pump is utilized as the driving means, that is the primary fluid power source. This standard pump, driven by the common power system, is sized accordingly to operate at its optimum design point, i.e., point of highest efficiency.

In connection with the above drive system, a standard powered pump operating at its optimum design point, a booster unit is employed to obtain the desired flow and pressure output from the system.

In order to more fully describe this invention, the booster is explained in detail. This device can be constructed in a multitude of forms with specific reference to the three distinct known designs in the field of turbomachinery, i.e., that of centrifugal, axial, or mixed flow configurations.

Basically, the booster includes a turbine which in turn drives a pump (for obtaining the desired output flow and pressure) supported on a suitable bearing system all contained in an appropriate housing.

The system operates on the basis that all or a portion of the output from the standard pumping means, i.e., a driven conventional centrifugal pump, is directed by way of transfer line from the output of the drive pump to the booster. Most of the input flows through the turbine of the booster, the turbine driving the impeller of the booster. The balance of the supplied energized fluid, or a separate fluid is acted upon by the impeller of the booster and is thus discharged at the desired flow rate and pressure.

According to this invention, the required speed necessary to obtain the desired output from the booster pump is obtained by turbine of the booster. Since the booster is not mechanically connected to the primary drive means, the booster can operate at the required speed necessary to produce the desired pressure at its output. Thus, in cases where a high pressure low-flow output is required, the booster will operate at a much higher speed than that of the primary pumping unit.

The turbine of the booster which functions as a drive is designed to operate at its most efficient point and at the speed which is required by the pump of the booster.

This invention allows for almost unlimited design flexibility to meet a great range of output requirements because of the added freedom allowed by being able to operate the booster at any speed independent of that which would be imposed by the use of 60 Hertz power (i.e., a 3500 rpm limitation) as normally employed with the conventional direct drive methods.

This flexible approach can also be employed in the opposite manner whereby an inward radial flow booster turbine is used to operate an axial flow type booster pump impeller. This type of device would be used where the desired output would be at a low pressure with a high flow rate. Such a device might be required in heat transfer systems where the high flow rates would be desired for their cooling or heating requirements. Here, again, the optimum system may be designed to meet any output requirements by designing the optimum components (primary fluid power source and turbine and booster pump) with the speed being chosen as that best suited to accomplish the desired result.

By way of analogy, this invention is akin to the well known piston type intensifier whereby different size piston areas are utilized to effect a change in the flow-pressure requirements. However, according to this invention, rotating components are used to accomplish the required change in flow-pressure outputs by taking advantage of the specific characteristics associated with the different types of rotating component designs, namely those specific design types categorized as radial, mixed flow, and axial (propeller) impellers.

In order to affectuate long bearing and seal life it is desirous in some cases to operate at a lower speed than that required by a single stage booster pump. Therefore, depending on the given situation either a two stage or multi-stage boost pump unit might be best suited. This boost pump could also be driven by a multi-stage turbine where necessary. Due to the wide speed range available for the single stage turbine drive means (at optimum design conditions) a multi-stage booster turbine is needed only under unusual conditions.

In accordance with a preferred form of this invention, a conventionally driven centrifugal pump is used as the primary fluid power source. A substantial portion of the output of this pump is fed to a booster composed of a turbine driven pump which includes a turbine impeller, a shaft, a pump impeller supported on bearings, all mounted in a housing, the latter forming the fluid flow passage for the turbine impeller and the pump impeller. This majority of the output of the primary fluid power system forms the principal immediate source of power for the turbine which through a common shaft to the boost impeller powers the same. The turbine is capable of rotation at a high speed using at least a portion of the primary pump output. In this form, another portion of the primary pump output is ported to the booster pump where it is pressured to the desired output pressure. By using a turbine which is an axial flow turbine, the turbine will run at a higher speed for a given head than other types of turbines, e.g. Pelton wheel, Francis turbine, or radial inflow devices. Particularly useful in this and other forms of the invention is a turbine known as the "Kaplan runner", or an axial flow turbine.

In another form, the output of the primary power source, again a centrifugal pump, is ported to a booster stage composed of a multiple stage pump impeller mounted on a common shaft with a turbine. Here the entire output is fed through internal porting to the booster stage in which the booster pump is a multi-stage centrifugal pump.

It is also possible in accordance with this invention to use an axial flow multi-stage pump driven by a turbine having a common shaft with the booster pump impeller. Again a portion of the output of the primary pump is used to power the booster stage.

Where desired, the present invention may be used to provide high flow rates at low pressure by using the primary pump to drive a booster stage made up of a turbine and a separate booster pump connected to the turbine shaft, but sealed from the turbine stage. In this form of the invention the primary fluid power source output is used to power a turbine connected to drive a separate axial pump stage whose input may be a fluid different from that of the turbine stage. Thus, the primary power source may pump water to the turbine stage while the booster pump may pump a different material such as a corrosive material. Thus, only the booster pump stage need be constructed of corrosion resistant materials.

As variants, the turbine portion of the booster may include stator blade rows with a turbine which is generally of the axial flow type for effectively converting the given head into a higher turbine speed through other types of turbines.

It is also possible, by this invention to use a secondary pump stage, integral with the turbine shaft and upstream of the turbine in order to increase the speed further as compared to the same structure without the secondary pump stage.

Thus, the present invention offers considerable versatility in construction and operation of a pump system, especially from the standpoint of available power. High pressure and low flow rate or vice versa may be obtained. The system is self-compensating in the sense that the booster will reach its own operating level as controlled by the flow rate and head of the primary fluid source. If there is a departure from anticipated primary fluid source output, the booster stage will automatically adjust with some variation in output flow and pressure, or vice versa.

Thus, by this invention an efficient reliable, relatively inexpensive pumping system is provided for use with commercially available centrifugal pumps powered by 60 cycle (Hertz) power supplies using about 3500 rpm speed in the main pump drive, or between 1800 and 3600 rpm for gas or diesel drives.

The features and advantages of the invention may be understood from the following detailed description and accompanying drawings.

BRIEF DESCRIPTION OF THE DRAWINGS

In the drawings, which constitute a part of this specification, exemplary embodiments exhibiting various features hereof, are set forth, specifically:

FIG. 1*a* is a view in section showing the support structure shown in FIG. 1;

DESCRIPTION OF THE ILLUSTRATED EMBODIMENT

As required, a detailed illustrative embodiment of the invention is disclosed herein. The embodiment exemplifies the invention which may, of course, be embodied in other forms, some of which may be radically different from the illustrative embodiment as disclosed. However, the specific structural details disclosed herein are representative and they provide a basis for the claims which define the scope of the present invention.

Figures 1, 2, 10:
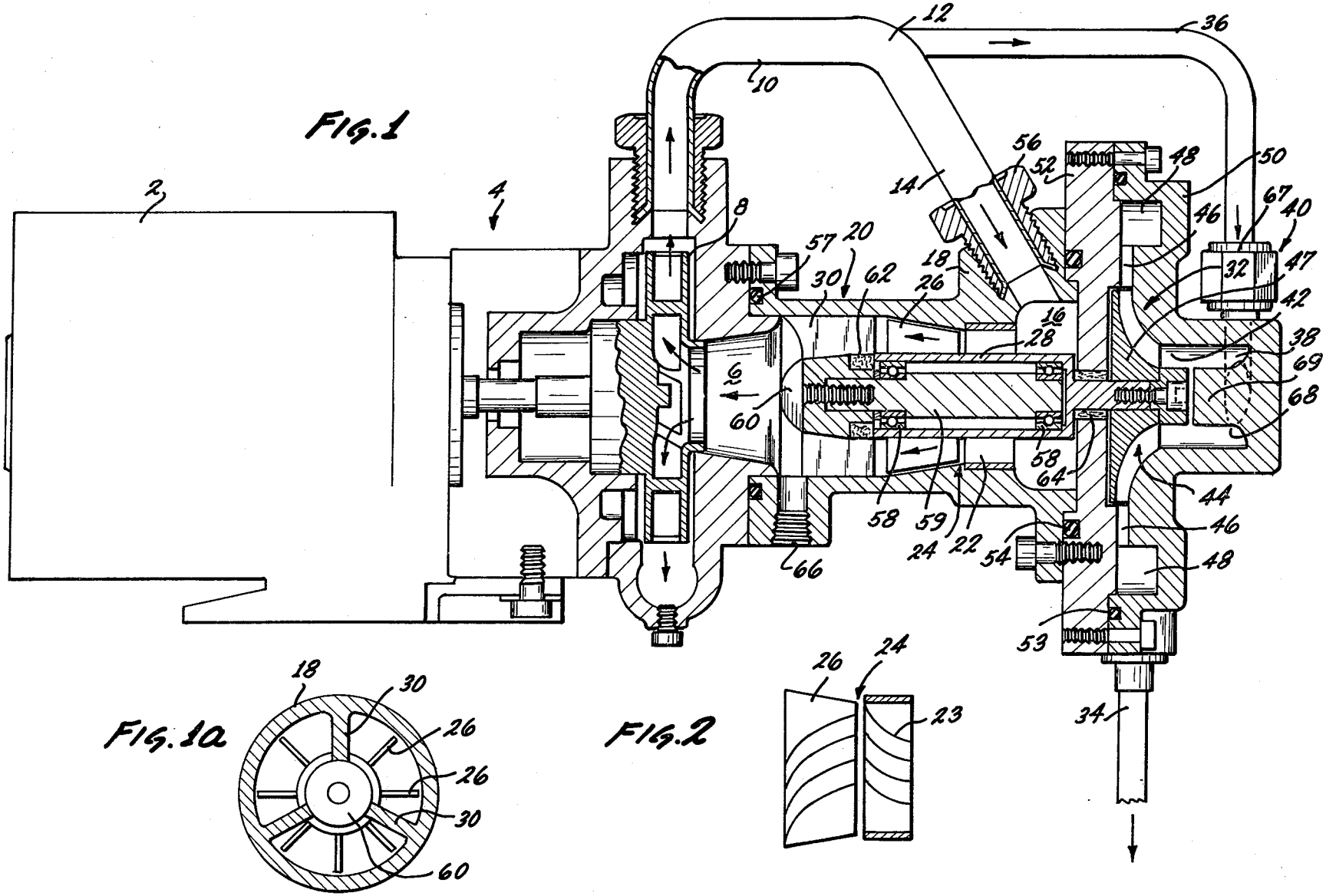
FIG. 1 is a view partly in section and partly in elevation of the pumping system of the present invention.
FIG. 2 is a view in section taken along the line 2—2 of FIG. 1.
FIG. 10 is a skeletal illustration showing a typical blade profile usable in the design depicted in FIG. 9.

Referring initially to FIG. 1, the pumping system of this invention is generally indicated to include a standard type of driving means 2 which may take the form of an electric motor or combustion engine driving a common type of pump 4 which may be of the centrifugal type. This standard type of pump 4 is sized accordingly to operate at its optimum design point, i.e., point of highest efficiency, with regard to the speed afforded by the drive means 2 and required power output. The relative size of the pump has been simplified for purposes of illustration. In practice the pump will be between two to three times the size of the assemblage to the right of the system shown in FIG. 1. The proper sizing of the pump for operation at highest efficiency is a matter well known to those in the art.

The mass flow at the optimum flow rate enters pump 4 through an inlet passage 6 and is propelled by the pump's impeller 8 through the pump and into a transfer pipe 10 at the optimum pressure afforded by the given pump design. At the junction 12 the main portion of the fluid flow is transferred by pipe 14 into chamber 16 contained in the housing 18 of the boost section 20 of the unit which is assembled to the right of the pump 2 of FIG. 1.

From chamber 16 the flow then proceeds through a plurality of stator blades 22 supported by the housing where its pressure is decreased by an expansion process afforded by the stator blade shape 23 thus in turn increasing the flow's velocity at point 24, which is the zone between the stator blades 24 and a plurality of turbine blades 26.

The stator blades 22 also direct the flow so that at point 24 it will enter the moving turbine blades 26 at the correct entrance angle. Upon the passage of fluid through the turbine blades 26 the fluid imparts its energy to a turbine shaft 28 via the blades 26 affixed thereto. The flow thus exhausting from the turbine is diffused by the straightening vanes 30 mounted on the housing prior to reentry of the fluid to the pump 4 through passage 6. By means of the correct stator blade design geometry 23 (FIG. 2) relative to the turbine blade design geometry 66 (FIG. 2) high speeds are obtained in the rotating components of the booster section 20. Also by proper design a very efficient energy conversion is accomplished whereby the decrease in energy content of the fluid flow is utilized as power is transmitted through shaft 28 to a booster pump impeller 32 mounted on the turbine shaft.

The amount of the flow required at the output 34 of the booster pump impeller is the balance of the flow that proceeds from junction 12 through pipe 36 to inlet chamber 38 of the boost pump 40. This flow enters the boost pump impeller 32 at point 42 and is energized by the boost pump's blades 44 which are attached to the impeller hub 47 and driven by the shaft 28. Upon the exit of said flow from blades 44 the velocity of the fluid is converted to pressure by means of a diffuser section 46 which may be either of the vaned or vaneless type. The total energy content of the boost pumped fluid is manifested by a high pressure which is obtained both by the direct effect of centrifugal action created by the blades 44 and rotation of impeller 32 and the conversion of the velocity imparted by blades 44 into potential energy, i.e., pressure, in the diffusor section 46. The pressurized fluid is collected in a volute chamber 48 and expelled via exhaust port 34. The volute chamber 48 and diffuser section 46 is formed by the boost pump outer housing 50 in conjunction with the boost pump intermediate housing 52 secured as shown.

The outer housing 50 is sealed to the intermediate housing 52 by an o-ring seal 53 or other suitable seal while the intermediate housing is fixed as shown and sealed by seal member 54 to housing 18, the later including a fitting 56 communicating with chamber 16 and receiving the conduit 14 through which between 80 to 90% of the output of the primary fluid source, pump 4, passes. As shown, the other end of the housing 18 is affixed to pump 4 and sealed thereto by an appropriate seal member 57 in the form of an o-ring seal. If diffuser vanes are employed in the diffuser section 46 they can be directly attached to either housing 50 or 52 respectively.

The rotating shaft 28 is supported by suitable bearing 58 which as shown are ball bearings. However, suitable hydraulic-type or oil bearings may also be employed. The bearings 58 are in turn supported by a non-rotating member 59 which is affixed to a support structure composed of diffuser vanes 30 and outer housing 18 and solid inner hub 60, the latter affixed to the stationary shaft 59 as shown. A conventional free seal 62 is utilized to effectively prevent any of the pumped fluid from entering the bearing housing in which said bearings 58 are contained. A labyrinth type seal 64 is employed between the housing 52 and rotating shaft 28 to prevent any of the high pressure fluid from entering chamber 16.

The system inlet port 66 is provided in housing 18 forward of the pump inlet 6 in the area of the hub 60. The amount of fluid entering the system equals the amount of fluid leaving through outlet 34, the fluid entering the booster into a low pressure chamber 6 prior to entry into the primary fluid power impeller 8.

Figure 3:
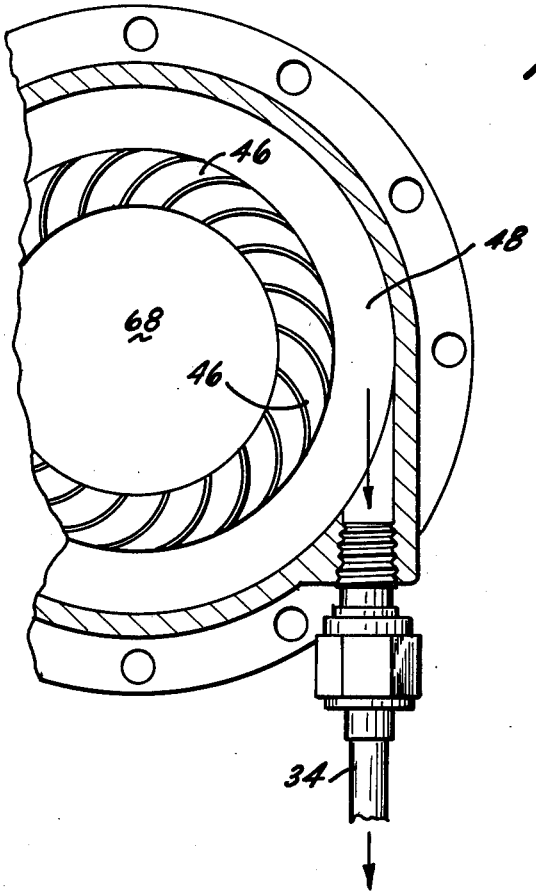
FIG. 3 is a view in section taken along the line 3—3 of FIG. 1.

As shown in FIG. 3, the diffuser section 46 is inwardly of the volute section 48 which terminates in output 34. If a vaned diffuser section is employed, vanes 68 are positioned in the diffuser section 46.

As shown in FIG. 1, the fluid entering the booster pump 40 if from conduit 36 coupled at 67 to the inlet side of the booster pump which includes a prewhirl chamber 68 upstream of the booster impeller and formed by a center post section 69 such that fluid enters the chamber tangentially and starts to whirl as it enters the booster hub impeller.

In overall operation, between about 80 to 90% of the output of pump 4 is ported to chamber 16 while 10 to 20% is ported to the booster pump section. From chamber 16 the fluid flows between shaft 28 and the housing and through the stator stage 22 where the pressure is decreased because of the expansion process thus increasing the velocity of the fluid in zone 24 prior to entry into the turbine stage. The stator blades 23 also direct flow to the turbine blades to effect rotation thereof and the shaft 28 to which they are connected. As the fluid leaves the turbine stage, it enters the low pressure section formed or to the left (as seen in FIG. 1) of the turbine blades and forward of the hub 60. Fluid also enters the low pressure section through inlet 66 and both fluids then enter the pump 4 through pump inlet 6.

The booster pump is connected to the same shaft 28 to which the turbine blades 26 are connected thus causing rotation of the boost pump impeller at the same speed as the shaft. A portion of the fluid from pump 4 enters the boost pump through conduit 36 in tangential manner in the prewhirl section 68 and then through the pump where the pressure is increased. The amount of fluid entering inlet 66 equals that leaving outlet 34 so that a portion of the output of pump 4 is cycled through the turbine stage of the booster. Thus the booster effectively forms a relatively simple device to convert the output of pump 4 to a high pressure low flow rate system wherein the pressure and flow rate may be varied by varying the size and geometry of the booster. It is also significant that the turbine and booster pump will seek a steady state free running operation dependent upon the pressure and flow rate of the pump 4. As long as the pump 4 performs at or near its design pressure and output, the booster will provide an output pressure and flow rate at or near the designed pressure and flow rate. Significant is the fact that there is no mechanical connection between the pump impeller and the booster in the context of a common driven shaft. Thus, the booster will achieve an equilibrium running condition based on performance of pump 4.

Figure 4:
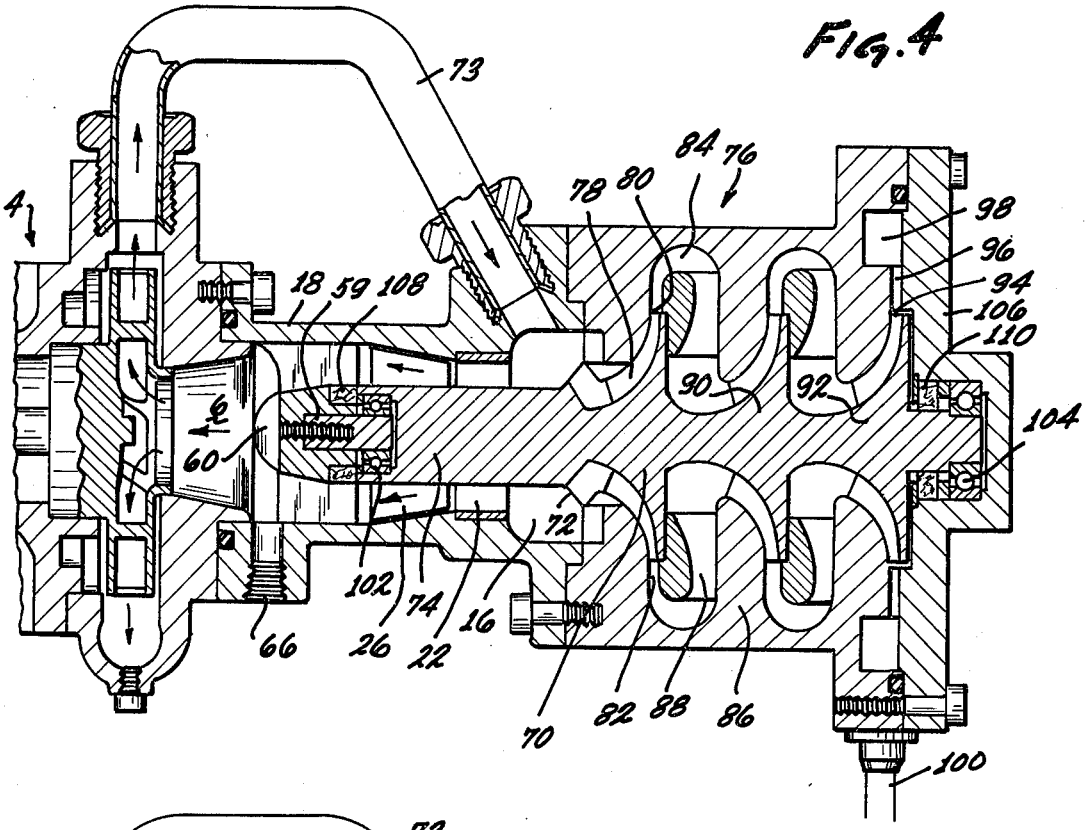
FIG. 4 is another form as represented by a schematic view in section of the system of the present invention relating to a multi-stage centrifugal pump component of said system.

If the desired system output pressure is sufficiently high, a multi-stage booster pump system such as shown in FIG. 4 may be used. The required output flow enters the first impeller 70 at point 72 which is in chamber 16 from inlet 73 from pump 4, the latter already described. The balance of the flow proceeds through the stator blades 22 to power the drive turbine 26 which imputs its derived power to shaft 74 on which the turbine blades are fixed, and thus transmits the necessary power to the multi-stage impeller section 76 of the booster pump. The inlet 16 receives the flow from inlet 73 and in this form defines an internal passage such that the entire output of the primary pump 4 flows through the turbine booster stage.

The output fluid upon entering impeller 70 at point 72 is energized by blades 78 and leaves the impeller at point 80 where its velocity energy is converted into pressure by means of the vaneless section 82 whereupon the flow is diverted by passage 84 contained in booster pump housing 86 into the vaned diffuser 88 where the remaining tangential velocity of the fluid is converted into pressure. Upon exiting from said vaned diffuser 88 the required output flow enters the second impeller 90 where its pressure is further increased in the same manner as described.

In FIG. 4 the arbitrary number of stages shown is three and consist of three impellers 70, 90, and 92 with their corresponding vaneless diffusers, turning passages, and vaned diffuser sections. Upon exit from the last impeller 92 at point 94 the output fluid is further diffused in section 96 and then collected by volute chamber 98 whereby it exits through pipe 100.

In the specific embodiment as shown in FIG. 4, the rotating shaft 74 is supported by an inner bearing 102 and outer bearing 104 contained in the boost pump outer housing 106. The inner bearing 102 and outer bearing 104 are appropriately sealed against the fluid and dust particles by seals 108 and 110 respectively.

As already described, the boost pump outer housing 106 is sealed to housing 86 by seals, as shown, while housing 16 is also sealed to housing 86 and the housing of pump 4. Fluid leaves the turbine and enters the pump through inlet 6 while system input fluid enters through inlet 66 in an amount equal to that leaving booster pump outlet 100. In this form the stationary shaft 59 is shorter axially than that of FIG. 1 and includes the hub 60 located generally in low pressure section adjacent inlet 66. The stator and turbine blades are as shown in FIG. 2 while the support structure is as shown in FIG. 1*a*.

In the form of the invention illustrated in FIG. 4, conduit 73 carries the entire output of the pump 4 to the booster stage which includes an internal porting of fluid to the booster pump section. Again, as in FIG. 1, a portion of the output of pump 4 is cycled through the turbine while a portion is the system output through outlet 100 but at a much higher pressure than the system of FIG. 1 because of the multiple stage booster pump. As already noted, the pump 4 is in practice much larger physically relative to the booster, but for simplicity of illustration is shown as indicated.

Thus, in the systems of FIGS. 1 and 4, outputs of between 300–700 psi per stage at rates of between 5 and 500 gallons per minute may be obtained with appropriately sized primary fluid power sources and appropriate boost systems in accordance with this invention.

Figure 5:
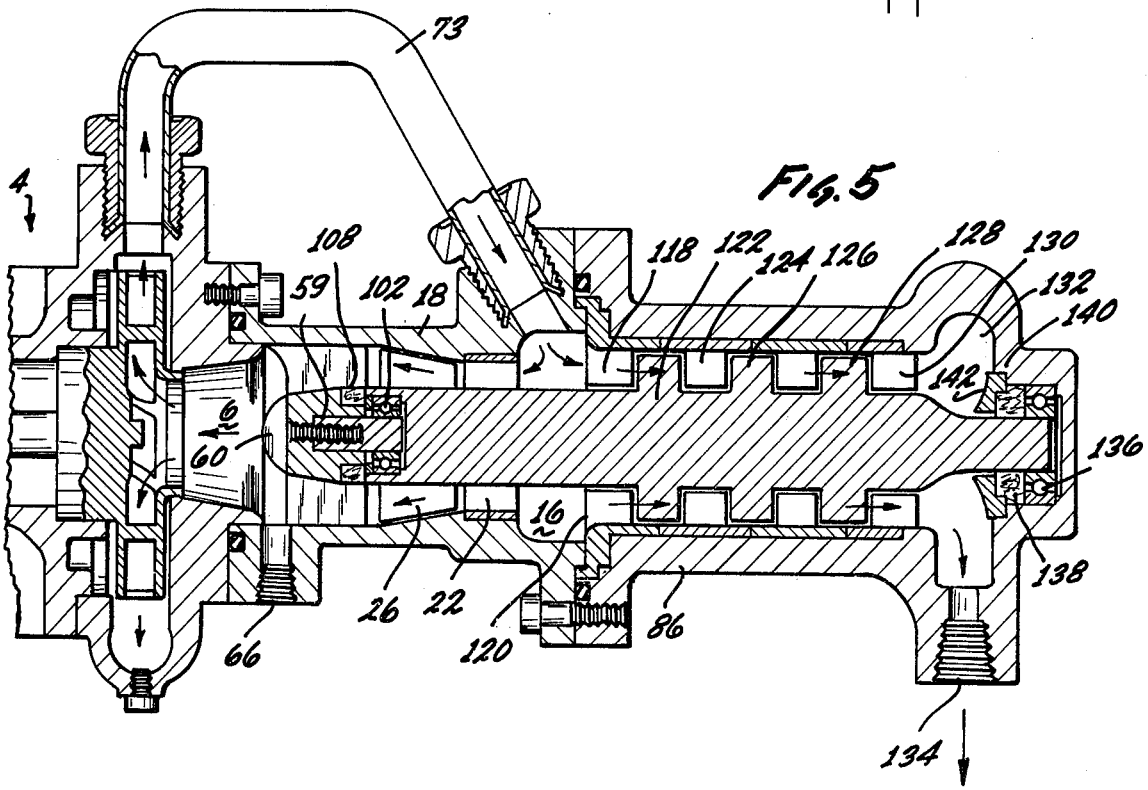
FIG. 5 is another form as represented by a schematic view in section of the system of the present invention relating to a multi-stage axial pump component of said system.

In similar fashion a multi-stage axial pump arrangement can be utilized as shown in FIG. 5. More specifically, the required output flow enters the inlet guide vane row 118 at point 120 from chamber 16 provided in housing 86. The guide vanes are part of the housing and from the guide vanes the flow is properly directed to enter the first rotor stage 122 of the pump whereupon it is both pressurized and its velocity increased. The stator blade row 124 serves to convert the velocity energy into pressure by a diffuser action and also to direct its remaining velocity direction so that the output flow will enter the second blade row 126 efficiently. This process is repeated in each stage until the desired pressure is achieved and is dependent on the number of stages employed at the given speed of the rotating members. Upon exiting from the last rotor stage 128 the output flow is diffused by the last stator row 130 prior to its being collected in chamber 132 for distribution to outlet pipe 134. The stator rows and rotor rows respectively are of similar design for liquids (incompressible fluids) while each stator row and its corresponding blade row would be of suitable design when utilized for compressible fluids (gases).

Suitable bearings 136 are kept from being contaminated by the fluid being pumped by an appropriate seal 138 which is held into the main housing 140 by a keeper 142.

The remaining structure of the unit of FIG. 5 is as shown in FIG. 4 which shows a radial multi-stage booster pump rather than the axial flow multi-stage booster pump of FIG. 5 in which the same reference numerals have been employed.

Figure 6:
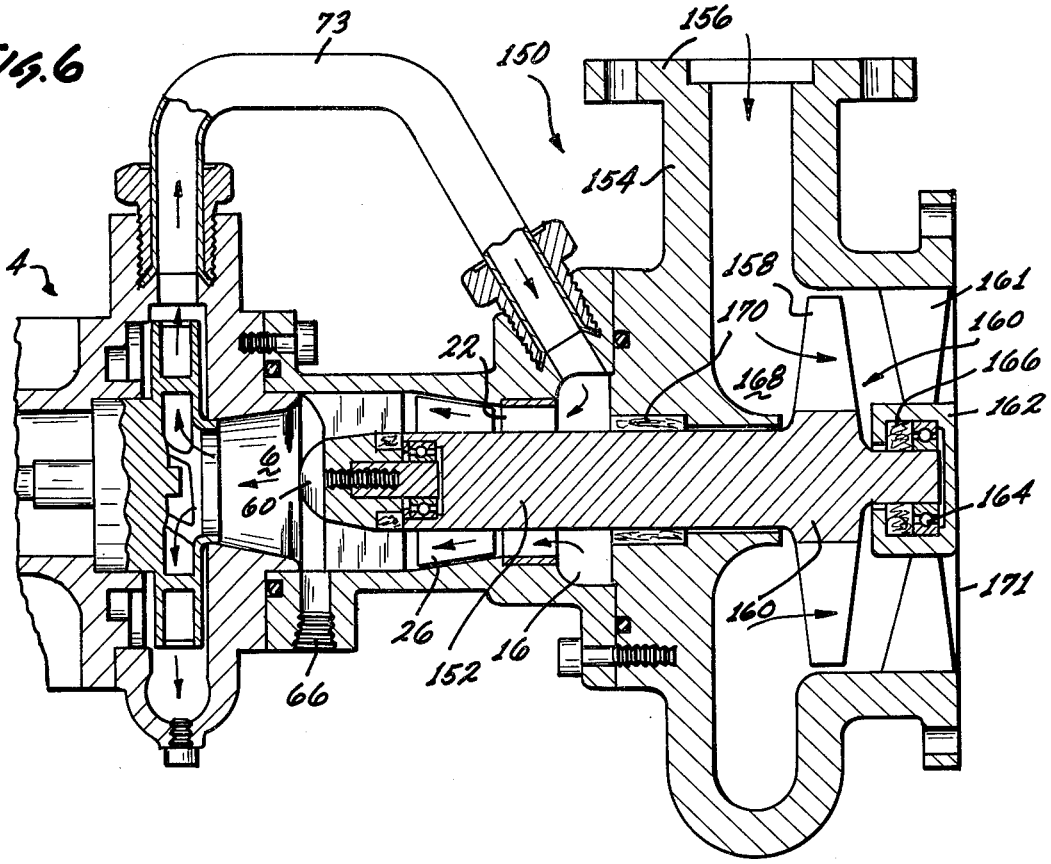
FIG. 6 is another form as represented by a schematic view in section of the system of the present invention relating to a high volume flow output pumping system.

If the required output volume is high it is desirous to employ the type of system as exemplified by FIG. 6. In this embodiment the said turbine 26 powers a low pressure high volume flow pump impeller 150 through shaft 152. The specific type of impeller used in the case is commonly known as a propeller type or of the axial flow variety. The pumped fluid enters the pump housing 154 through flange 156 and proceeds through the blades 158 attached to the hub 160 which can be integral with the shaft 152. The fluid is energized by the impeller 160 and the tangential velocity which is imparted to the fluid by blades 158 is received in the diffuser section by the vanes 161 on the housing 154. The diffuser vanes 161 form an integral support member between main pump housing 154 and outer bearing hub 162. The outer portion of shaft 152 is supported by suitable bearing means 164 contained in said bearing hub member 162 and appropriately sealed from the fluid being pumped or dirt particles contained therein by seal 166. Any leakage between the inner chamber 168 of the pump and the chamber 16 contained in the turbine drive section of the boost pump is prevented by a suitable seal 170 which may be of the labyrinth variety or the face seal type depending on the particular requirements. Any leakage of the fluid out of the turbine drive section is replaced by addition of fluid through inlet port 66 which may be connected to a suitable reservoir.

The system of FIG. 6 again includes flow inlet 73 from the outlet of pump 4. As previously described, fluid enters inlet 66 through pump inlet 6 into pump 4 then to line 73 into the turbine including stator blades 22 and turbine blades 26 on shaft 152. The shaft 152 is rotated to rotate the impeller of a separate pump in housing 154. The pump may be of a corrosion resistant alloy while the turbine and pump 4 may be of an alloy not needed for corrosive fluids since water may be used from a reservoir connected to inlet 66. The unit of FIG. 6 may provide a high volume low pressure flow rate from a pump 4 of standard design through discharge 171 of the pump.

Figure 7:
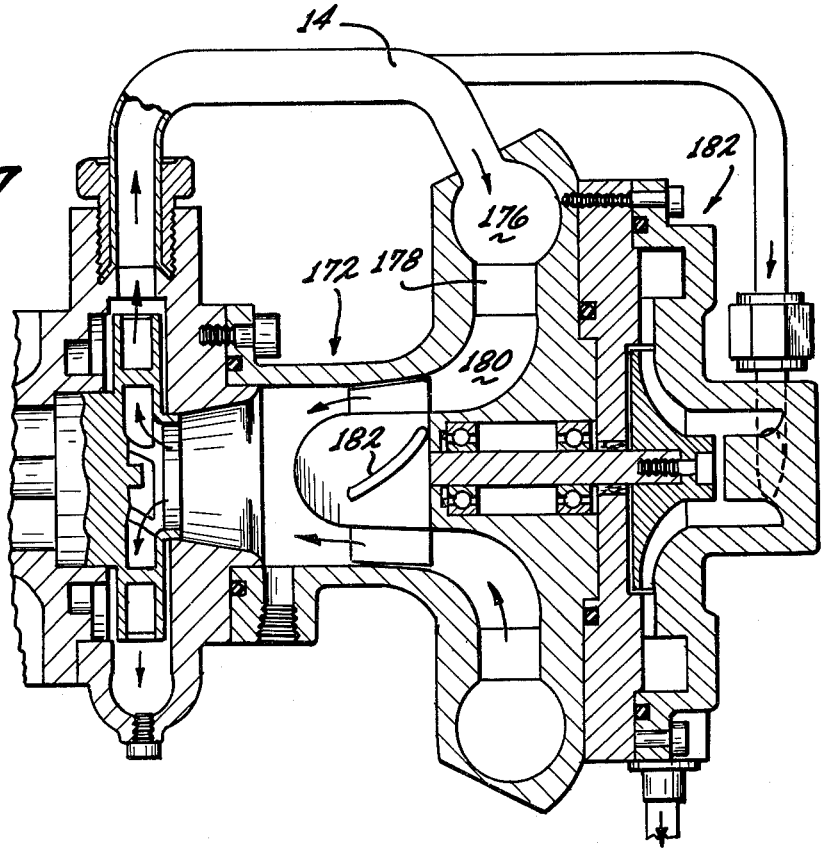
FIG. 7 is a schematic view in section of the system of the present invention in which the stator blade row of the turbine drive section are of radial orientation.

FIG. 7 is illustrative of a booster power section design in which the component arrangement of the turbine section 172 is better suited in systems limited to areas in which it is more convenient to locate the stator section 178 oriented in a radial fashion as opposed to the axial orientation as previously described. In this design the portion of the fluid utilized for powering the booster section enters a plenum chamber 176 via transfer pipe 14. The tangential velocity component is imparted to the said fluid by radial oriented stator vanes 178. The fluid is then directed by means of an axial symmetric chamber 180 to the propeller type of turbine runner 182. In some requirements this design is more convenient from a spatial design standpoint since the stator blades 178 are somewhat rearward from the turbine runner 182. The basic concept of the overall pumping system is to effeciently employ the given optimum design of different types of rotating machinery design to obtain the required speed increase as required by the optimum boost pump design.

FIG. 7 is specifically illustrative of this fact whereby the main pumping means 4 is the standard type of centrifugal pump being driven by a conventional type of motive power. By the use of an electric motor then the input speed to pump 4 would be approximately 3500 rpm when using the common available 60 Hertz current. Since the propeller type runner will operate at many times the speed for the same head as produced by pump 4 at its optimum efficiency the resulting turbine runner speed at its respective optimum efficiency will result in a large speed multiplication which is thereby used by the booster pump 182 so as to obtain the required high pressure output from the said booster pump at its optimum design point--thus effecting a convenient and efficient high pressure pumping system.

In the form shown in FIG. 7, the radial stator blades may be eliminated if a tangential flow input is used. This provides a vaneless inlet with a Kaplan runner and reduces the cost while providing a wide range of operation.

Figure 8:
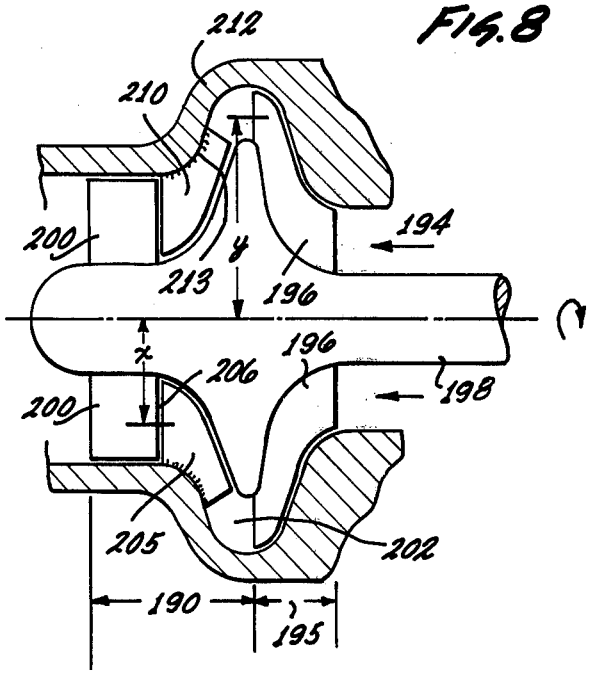
FIG. 8 is a schematic view in section of the turbine portion of the present invention illustrating an arrangement for obtaining the required high speed.

FIG. 8 specifically illustrates a design in which the turbine can be made to operate at its maximum efficiency at the required high rotating speed as determined by the boost pump essentially independent of the input pressure supplied by the driving portion of the system. By use of this design almost any practical speed can be obtained; so that the required output flow conditions can be achieved at the optimum speed required by the boost pump simultaneously and in conjunction with the given output flow and pressure as supplied by the main driving pump portion of the system.

With reference to FIG. 8 the portion of the flow utilized for driving the turbine section 190 enters the drive section at point 194 at the given pressure and flow supplied by the main pump 4 as depicted in FIG. 1. The main pump system is designed to operate at its maximum efficiency with respect to the given input speed available and the total overall power requirements. Thus, with these two given restrictions, both the driving mass flow rate and pressure are fixed and exist at point 194. However, since there is a direct relationship between any given available pressure "head" and the speed at which an optimum efficient turbine will operate there may be situations in which the required speed of the turbine for efficient boost pump applications may not be attainable with the established output conditions existing at said point 194, especially with respect to the given pressure. However, if a pumping type device such as the radial blades 196 attached to the drive shaft 198 which is respectively driven by turbine blades 200 which are also attached to drive shaft 198 the turbine drive can be constructed so as to have its maximum efficiency occur at the desired speed required by the boost pump section as driven by shaft 198. In effect the radial blades 196 act as another stage with respect to the main pump 4 as shown in FIG. 1, so as to increase the available head and thereby obtain the required higher speed. Since, this result is immediately utilized by the turbine 200 the tangential velocity obtained at point 202 is utilized directly and therefore no diffuser action is required after the pump section 195 which is comprised of the radial blades 196 mounted on the said shaft 198.

The tangential velocity at point 202, i.e. the velocity existing in a plane perpendicular to the axis of rotator 198 at point 202 excluding its radial velocity component; is increased in either a vaneless expansion chamber 205 as illustrated by the region between point 202 and point 206 due to the conservation of angular momentum as the fluid flow path's radial distance decreases, i.e. the distance between point 206 and center line of the axis of rotation designated as $x$ as compared to that distance as designated as $y$.

Blades 200 are designed accordingly to the velocity and diameter of entrance of the fluid at point 206 so as to efficiently convert the dynamic energy of the flowing fluid to power via the rotation of shaft 198 all occurring in the most efficient manner at the desired output speed.

An alternate to the just mentioned design includes optional guide vanes 210 which are employed to increase the velocity and direct the fluid prior to its entrance to the turbine 200 at point 206. The guide vanes 210 are fixed in a stationary manner to the turbine case 212 along surface 213. By use of guide vanes 210 the peak efficiency can be slightly increased at the expense of a more limited efficient operating speed range. However, depending on the design requirements the option of guide vanes 210 versus vaneless acceleration as would occur in the free volume designated as the space between point 202 and 206 respectively allows for great flexibility in obtaining the optimum results.

Figure 9:
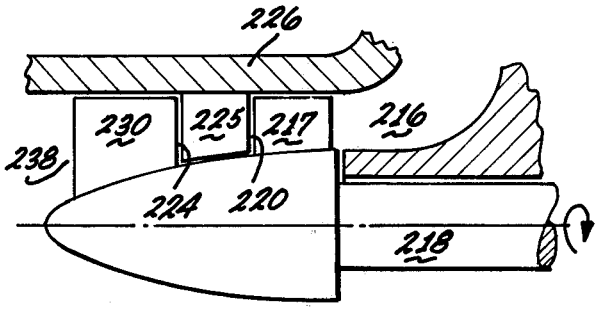
FIG. 9 is an alternative schematic view in section of the turbine portion of the present invention illustrating an arrangement for an axial flow turbine drive for obtaining the required high speed.
Figure 10:
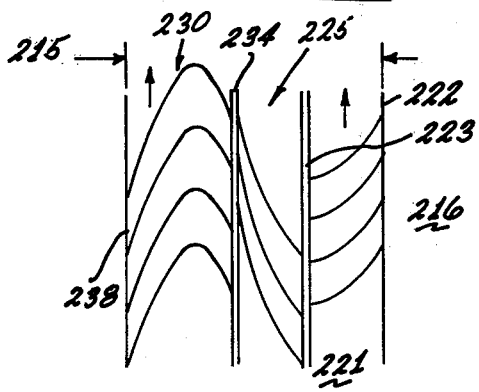

The just described design can be obtained at high efficiencies by the turbine drive which can be in the form of an axial design as shown in FIGS. 9 and 10. The portion of the flow utilized for driving the power section 215 enters at point 216 at the given pressure and flow supplied by the main pump 4 (referring to FIG. 1). The blades 217 attached to the power output shaft 218 essentially increase the energy content of the working fluid so that upon its exit at point 220 its energy content has been increased both from the potential (pressure) and kinetic (velocity) standpoint. This addition of energy is imparted by the moving axial pumping blades 217 as the flow passes through the pump section 221 between point 222 to point 223. As the fluid exists from the pumping blade row 217 at point 220 it enters the stationary blade row consisting of blades 225 attached to the housing 226. These stator blades correctly redirect the flow and somewhat further expand the flow so that it enters the turbine blade rows 230 attached to said shaft 218 in the correct direction at the desired velocity. Since optimum speed of the turbine 230 is a function of the total energy contained in the working fluid i.e. the higher the energy content of the working fluid the higher is the optimum turbine speed; thereby, the given turbine can be designed to generate at high efficiencies occuring at an optimum high speed design point. The total power output is the result of the turbine power produced between region 234 and 238 minus the power required by the pump between region 223 and 222 minus the vectorial losses. This power output is also equivalent to the overall efficiency of the given drive portion as depicted in FIGS. 8 and 9 multiplied by the total energy contained in the fluid as between where it enters at region 216 and exhausts at point 238 times the mass flow rate of the working fluid.

FIG. 10 is illustrative of an example of the blade profiles in skeletal form as might be utilized by said power section 215. The pump portion is defined as that region occupied by pump blade 217 between points 220 and 222 respectively. The stator portion is defined as that region occupied by stator blades 225 between points 234 and 220 respectively. And, the turbine section is defined as that region occupied by turbine blades 230 between points 238 and 234 respectively.

To illustrate the design approach in accordance with this invention, if it is assumed that the system output is 60 gallons per minute and 500 psi, the mass flow rate (for water) is 8.346 pounds/second and a head of 1153.29 ft.-lb/lb with a power input (ideal) of 17.50 horsepower. If it is assumed that the efficiency of the primary pump source and the boost pump and turbine is each 0.85 then the required horsepower input is 28.5 horsepower. From these calculations the power source is rated at 28.5 horsepower. Since the prime pump is not 100% effective, the hydraulic output of the prime pump is 24.22 horsepower and also the input to the turbine-booster pump unit. The power in foot-lb/sec. is 13322 from the prime pump.

To obtain the optimum required head and size of the primary pump, one then refers to the $N_s$ $D_s$ curves, which are well known published curves, see Journal of Engineering for Power, Transactions of the ASME, January, 1962 pages 83 to 114. Assuming an optimum specific speed ($N_s$) of the prime pump impeller of 70, calculations using the $N_sD_s$curves, and assuming a 3500 rpm of the pump motor, then the calculated optimum output head of the primary pump is 194.4 ft.-lb./lb., or head or about 84.6 psi for water.

Knowing the hydraulic output of the pump is 13322 ft-lb/sec., the output mass flow from the primary pump is 68.179 lb/sec. or 490 gallons per minute of water. Thus, performance data for the primary pump and power system is now known.

Similarly from the $N_s$ $D_s$ curves, using an optimum specific diameter ($D_s$) of 1.9 in conjunction with the required performance, the optimum diameter for pump impeller is 6.373 inches.

The difference between the primary pump head of 195.4 ft-lb/lb and the required output head of 1153.29 ft-lb/lb is 957.89 ft-lb/lb. From the latter number and a required system output flow of 60 gallon/min, and using an optimum $N_s$of 70 and an optimum $D_s$of 2.3, from the $N_sD_s$curves, the optimum rpm required for the booster impeller is 32964 rpm. The corresponding optimum diameter of the booster pump impeller is 1.86 inches.

Knowing the primary pump output of 490 gallon/min and system output of 60 gallons/min, the flow through the turbine stage is 430.12 gallons/per minute. Once again, using the $N_s D_s$ curves for turbines, and in conjunction with the booster impeller rotator of 32964 rpm, the optimum turbine diameter would be 1.88 inches at the same speed at optimum efficiency.

In the case of a two stage boost pump driven by a single stage turbine, the optimum speed would be reduced to 19583 rpm and the optimum diameter of both boost pump and turbine impellers is 2.2 inches.

One of the modifications that may be made is to provide adjustable axial or radial stator blades in the turbine which may be pivotally pinned on the housing and whose pitch angle may be varied to effect the desired tangential velocity with respect to the turbine blade inlet. Adjustment may be effected by conventional well known externally mounted controllers.

While the preferred form of this invention relates to fluid systems, especially liquid systems in which the same or different liquids may be used, it is understood that the principles of the present invention may also be used in gas-liquid, gas-gas and liquid-gas systems.

Of course, various other modifications and changes in the system as disclosed herein will be readily apparent to those skilled in the art. As a consequence, the scope hereof shall be deemed to be in accordance with the claims as set forth below.

I claim:

1. A booster system for use with a primary fluid power source in the form of a pump having an inlet and an outlet and including an impeller of a predetermined diameter and means continuously rotating said impeller at a predetermined speed to produce an output at a high efficiency based upon horsepower comprising:

means forming a booster housing having an inlet port normally continuously receiving a major portion of the fluid from the outlet of said pump;

shaft means rotatably mounted in said housing and including turbine means on one end thereof;

inlet chamber means in said housing receiving said flow from said inlet port for driving said turbine means;

booster pump means including fluid inlet means and fluid outlet means mounted on one end of said housing;

said fluid outlet means of said booster pump means forming the principal fluid outlet of said booster system;

said shaft including a portion thereof extending out of said housing toward said booster pump means;

at least one booster pump impeller means mounted on the said portion of said shaft and driven by the fluid which passes through said turbine means;

said housing at the other end including means to mount said housing for fluid communication with the inlet of the pump;

means forming a low pressure section between said turbine and said pump mounting means, fluid input means communicating with said low pressure section whereby fluid entering said section is pumped by said pump to the turbine to drive the impeller of the booster pump means;

said turbine being of a specific speed higher than that of the primary fluid power source pump to effect a speed increase in said booster pump means.

2. A booster system as set forth in claim 1 wherein said fluid inlet means of said booster pump means received a portion of the fluid output of the pump.

3. A booster system as set forth in claim 1 further including transfer line means for effecting a flow of a portion of the output of the pump to said inlet port and a portion to the fluid inlet means of said booster pump means.

4. A booster system as set forth in claim 3 wherein the flow rate of said fluid input means substantially equals the rate of flow of the fluid at the outlet means of said booster pump means.

5. A booster pump system as set forth in claim 1 wherein said booster pump means includes a multiple stage pump impeller.

6. A booster pump system as set forth in claim 1 wherein said turbine blade means is a Kaplan runner.

7. A booster pump system as set forth in claim 5 wherein said booster pump means is a multiple stage centrifugal pump.

8. A booster pump system as set forth in claim 5 wherein said booster pump means is a multiple stage axial flow pump.

9. A booster pump system as set forth in claim 1 further including stator blade means positioned to direct the flow of fluid to said turbine means.

10. A booster pump system as set forth in claim 9 wherein said stator blade means is adjustable.

11. A booster pump system as set forth in claim 1 wherein said booster pump means is a low head-high flow pump.

12. A booster pump system as set forth in claim 6 further including radial inlet guide vanes cooperating with said Kaplan runner.

13. A booster pump system as set forth in claim 1 wherein said turbine means includes added pumping means mounted on said shaft and cooperating with said turbine means.

14. A booster pump system as set forth in claim 13 wherein said added pumping means is centrifugal pumping means.

15. A booster pump system as set forth in claim 14 further including stator vane means cooperating with said added pump means.

16. A booster pump system as set forth in claim 13 wherein said added pumping means in conjunction with said turbine means is of an axial flow configuration employing axial stator means.

17. A booster pump system as set forth in claim 1 wherein the fluid which flows through said pump means is a fluid different from that which flows through said turbine means.

18. A booster pump system as set forth in claim 1 wherein said housing includes means to effect flow of a portion of the incoming fluid to said pump means.

19. A pumping system for obtaining controlled flow rates and pressure comprising:

primary pump means having an inlet and an outlet and including an impeller of a predetermined diameter and means continuously rotating said impeller at a predetermined speed to produce an output at a high efficiency based upon horsepower, booster turbine and pump means normally continuously receiving a major portion of the fluid from said primary pump means, said turbine booster and pump means including fluid outlet means forming the principal fluid output of said pumping system;

said turbine booster and pump means including a housing, turbine means on one end of said shaft and pump impeller means on the other end of said shaft, whereby fluid flow through said turbine means is operative to effect rotation of said pump impeller means, housing means cooperating with said impeller to form a booster pump having an outlet, means forming a fluid outlet from said turbine means to said primary pump inlet means, means cooperating with said housing forming a fluid inlet means; and said turbine being of a specific speed higher than that of said primary pump means to effect a speed increase in said pump impeller means of said turbine booster and pump means.

20. A pumping system as set forth in claim 19 further including means to seal said pump housing from the fluid flowing through said turbine means.

21. A pumping system as set forth in claim 19 including means to effect flow of a portion of the output of said primary pump to said pump impeller.

22. A pumping system as set forth in claim 21 wherein said means to effect flow is transfer means.

23. A pumping system as set forth in claim 20 wherein said turbine means is a Kaplan runner.

24. A pumping system as set forth in claim 20 further including means forming stator means cooperating with said turbine means.

25. A pumping system as set forth in claim 24 wherein said stator means is adjustable.

26. A pumping system as set forth in claim 20 wherein the rate of flow into said inlet of said housing is equal to the rate of flow out of said booster pump.

27. A pumping system as set forth in claim 20 wherein said booster pump is a multiple stage centrifugal pump.

28. A pumping system as set forth in claim 20 wherein said booster pump is a multiple stage axial flow pump.

29. A pumping system as set forth in claim 20 wherein said booster pump is a low head-high flow pump.

30. A pumping system as set forth in claim 23 further including radial inlet guide vanes cooperating with said Kaplan runner.

31. A pumping system as set forth in claim 20 wherein said primary pump procedures fluid output at a predetermined pressure and flow rate and wherein said system produces fluid output at a pressure greater than that of said primary pump.

32. A pumping system as set forth in claim 20 wherein said turbine means includes additional pumping means mounted on the same shaft.

33. A pumping system as set forth in claim 32 wherein said additional pumping means is centrifugal pumping means.

34. A pumping system as set forth in claim 33 further including stator vane means cooperating with said additional pumping means.

35. A pumping system as set forth in claim 33 wherein said additional pumping means in conjunction with said turbine means is of an axial flow configuration employing axial stator means.

36. A pumping system as set forth in claim 20 wherein the fluid which flows through said booster pump means is a fluid different from that which flows through said turbine means.

* * * * *